US009925811B2

(12) United States Patent
Elgee et al.

(10) Patent No.: US 9,925,811 B2
(45) Date of Patent: Mar. 27, 2018

(54) CONTROLLING OPERATION OF A PRINTER BASED ON DETECTION OF AN OPTICAL MARKER IN A PIGMENT INK

(71) Applicant: Hewlett-Packard Development Company, L.P., Houston, TX (US)

(72) Inventors: Steven B Elgee, Vancouver, WA (US); Jefferson P Ward, Vancouver, WA (US); Jayprakash C Bhatt, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/308,096

(22) PCT Filed: Jul. 31, 2014

(86) PCT No.: PCT/US2014/049211
§ 371 (c)(1),
(2) Date: Oct. 31, 2016

(87) PCT Pub. No.: WO2016/018387
PCT Pub. Date: Feb. 4, 2016

(65) Prior Publication Data
US 2017/0057267 A1 Mar. 2, 2017

(51) Int. Cl.
*B41J 29/393* (2006.01)
*B41J 2/175* (2006.01)
*B41J 2/195* (2006.01)

(52) U.S. Cl.
CPC ..... *B41J 29/393* (2013.01); *B41J 2/17546* (2013.01); *B41J 2/195* (2013.01)

(58) Field of Classification Search
CPC ..... B41J 29/393; B41J 2/17546; B41J 2/195
See application file for complete search history.

(56) References Cited

U.S. PATENT DOCUMENTS 6,000,792 A 12/1999 Koizumi et al.
6,213,600 B1 4/2001 Kobayashi et al.
(Continued)

FOREIGN PATENT DOCUMENTS

KR 100677602 2/2007
KR 10-1011516000 1/2011
WO WO-2014051549 4/2014

OTHER PUBLICATIONS

Hladnik, et al., Role of Paper Coating Pigments and Additives in Darkfastness of Ink Jet Prints, Journal of Imaging Science and Technology, vol. 52, No. 1, Jan. 2008, pp. 10507-1-10507-7(7) Society for Imaging Science and Technology.
(Continued)

*Primary Examiner* — Lisa M Solomon
(74) *Attorney, Agent, or Firm* — HP Inc. Patent Department

(57) ABSTRACT

Methods, apparatus, systems and articles of manufacture to control operation of a printer based on whether a marker is detected in a pigment ink are disclosed. Example apparatus include an optical sensor to detect a marker in a vehicle component of the pigment ink. The vehicle is depleted of a pigment component. The apparatus also includes a controller to control operation of the printer based on whether the marker is detected. The apparatus can also include an authorizer to determine whether the printer in which the pigment ink is installed is authorized to use the pigment ink having the marker. The controller of the apparatus is to control operation of the printer by transmitting a control signal to a print head processor to halt printing operations. The apparatus can additionally include a filter to deplete the vehicle component of the pigment component.

15 Claims, 7 Drawing Sheets

(56) References Cited

U.S. PATENT DOCUMENTS

| | | | |
|---|---|---|---|
| 6,585,818 | B2 | 7/2003 | Thakkar et al. |
| 7,438,378 | B2 | 10/2008 | Reichelsheimer et al. |
| 7,506,955 | B2 | 3/2009 | Yamamoto et al. |
| 7,695,555 | B2 | 4/2010 | Kabalnov et al. |
| 8,614,264 | B2 | 12/2013 | Aoki et al. |
| 8,770,736 | B2 | 7/2014 | Vasudevan et al. |
| 2006/0162612 | A1 | 7/2006 | Kabalnov et al. |
| 2009/0042191 | A1 | 2/2009 | Hayward et al. |
| 2009/0117350 | A1 | 5/2009 | Oyanagi et al. |
| 2011/0067597 | A1 | 3/2011 | Ganapathiappan et al. |
| 2011/0135815 | A1 | 6/2011 | Ganapathiappan et al. |
| 2011/0192318 | A1 | 8/2011 | Hayashi et al. |
| 2012/0137928 | A1 | 6/2012 | Ganapathiappan et al. |
| 2012/0174821 | A1 | 7/2012 | Bhatt et al. |
| 2012/0249623 | A1* | 10/2012 | Vasudevan ..... C09D 11/38 347/1 |
| 2013/0070015 | A1 | 3/2013 | Bhatt et al. |
| 2013/0176359 | A1 | 7/2013 | Roberts et al. |
| 2013/0215199 | A1 | 8/2013 | Silverbrook et al. |
| 2013/0221277 | A1 | 8/2013 | Ma et al. |
| 2013/0300799 | A1 | 11/2013 | Mizutani et al. |
| 2013/0314465 | A1 | 11/2013 | Lebron et al. |
| 2014/0026784 | A1 | 1/2014 | Valentini et al. |
| 2014/0098156 | A1 | 4/2014 | Taff et al. |
| 2014/0152742 | A1 | 6/2014 | Mizutani et al. |

OTHER PUBLICATIONS

International Searching Authority. Korean Intellectual Property Office. International Search Report. dated Apr. 21, 2015, Application No. PCT/US2014/049211, Filing date Jul. 31, 2014.

* cited by examiner

CONTROLLING OPERATION OF A PRINTER BASED ON DETECTION OF AN OPTICAL MARKER IN A PIGMENT INK

BACKGROUND

Various business models are used in the printer industry. In some business models, printer prices are set at levels that yield limited or no profit to thereby increase printer sales. Increased printer sales, in turn, yields greater ink consumption. In contrast, under a subscription-based business model, a user pays a subscription fee to lease a printer from a printer manufacturer or other printer service provider. As an incentive to enter into the lease agreement, the terms of the lease agreement can, in some instances, include a free supply of ink during the life of the agreement.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1A:
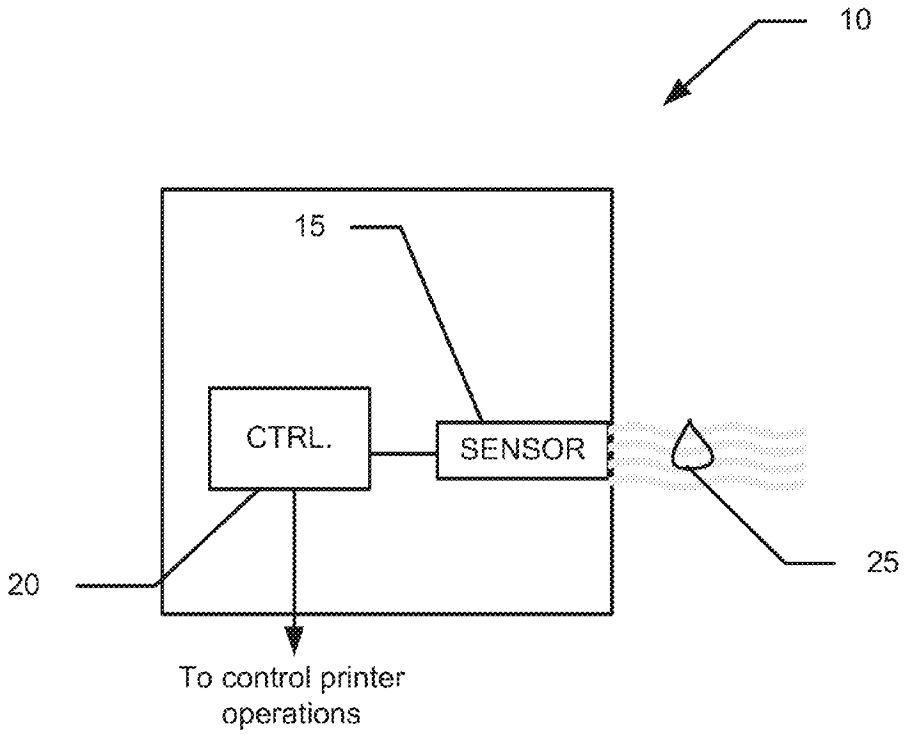
FIG. 1A is a block diagram of an example ink monitor having an example optical sensor and an example controller to control operation of a printer.

Example methods, apparatus, systems and articles of manufacture to control operation of a printer based on the detection of a marker in a pigment ink. A disclosed example apparatus includes an optical sensor to sense a marker in a vehicle component of the pigment ink from which a pigment component has been depleted. An example controller controls operation of the printer based on whether the optical sensor detects the marker in the vehicle component. Some example apparatus also include an authorizer to determine whether the printer in which the pigment ink is installed is authorized to use the pigment ink having the marker.

In some example apparatus, the controller controls operation of the printer by transmitting a control signal to a print head processor and the control signal causes the print head processor to halt printing operations. Some example apparatus additionally include a message generator. The controller causes the message generator to generate a message indicating that unauthorized ink consumption has been attempted. Some example apparatus also include a filter to deplete the vehicle component of the pigment component.

Some example methods include to detect an unauthorized attempt to consume pigment ink include determining, using an optical sensor, whether a marker is in a vehicle component of the pigment ink from which a pigment component has been depleted and detecting the unauthorized attempt to consume the pigment ink based on whether the marker is detected.

Some example methods include controlling operation of a printer in which the pigment ink is installed based on whether the unauthorized attempt is detected. In some example methods, detecting the unauthorized attempt is further based on whether a printer in which the pigment ink is installed is authorized to use the pigment ink having the marker.

Some example methods further include controlling operation of the printer in which the pigment ink is installed based on whether the unauthorized attempt is detected. Some example methods additionally include filtering the pigment ink to deplete the pigment component from the vehicle component.

In a subscription-based business model, a consumer can enter into a lease agreement with a printer manufacturer (or other third party). Under such a lease agreement, the consumer pays a one-time or recurring fee (also referred to as a "subscription fee"), in exchange for the usage of a printer (referred to as a "subscription printer"). As an incentive, some lease agreements include a free supply of ink (referred to herein as "subscription ink"), provided that the ink is used exclusively with the printer being leased. Unfortunately, ink supplied free of charge is at risk of being stolen, sold and/or used for unauthorized usage in non-leased printers.

To combat such unauthorized usage, ink and printer manufacturers have developed measures to detect and restrict the usage of subscription ink. Some such measures include supplying subscription ink in cartridges equipped with a memory device having identification information stored therein. The identification information identifies the ink as being subscription ink. An ink monitor installed in printers from such printer manufacturers accesses the identification information stored in the memory device to determine whether an installed ink is a subscription ink or a non-subscription ink. If the ink is a subscription ink and the subscription is either not present or is in arrears, the ink monitor can restrict the usage of the ink cartridge in the printer by rendering the printer inoperable while the ink is installed. However, such ink detection and restriction measures are ineffective if the identification information stored in the memory associated with the subscription ink cartridge has been tampered with. Likewise, such measures can be rendered ineffective by transferring subscription ink from a subscription ink cartridge into a non-subscription ink cartridge.

Another potential solution for detecting usage of subscription ink involves inserting a near infra-red ("NIR") marker into the subscription ink and installing a near infra-red (NIR) sensor that will detect the presence of the marker in printers. However, optical markers are not detectable when added to black pigment inks because of the spectral absorption characteristics of black ink.

Other possible solutions include adding ferrous particles to the subscription ink and using an optical sensor to detect the added particles. However, ferrous particles can be easily removed with a magnet and, when added in concentrations sufficient to allow for detection, the ferrous particles may adversely affect the appearance of color ink on paper.

Changing the ink impedance has also been explored but ink impedance is difficult to control and the chemical properties that affect the impedance of ink also affect the physical properties of the ink on paper. In addition, electronic impedance sensors can be rendered ineffective by modification and/or circumvention. Thus, there exists a need for detecting and restricting the usage of subscription inks.

Example methods, apparatus, systems and articles of manufacture described herein address some of these issues by being able to detect a marker added to a pigment ink, even when the pigment ink is black. Example methods and apparatus use an optical sensor to detect a marker after the pigment has been depleted from the ink. In the printer(s) of such an example, the pigment ink, which includes a pigment component and a vehicle component, undergoes a separation process by which the pigment component becomes depleted from a vehicle component. The vehicle component is the portion of the ink not including the pigment component (i.e., the portion of the ink not including pigment particles). The separation process can occur naturally in a nozzle firing chamber of the printer or, in some examples, the printer includes a filtration tool that causes the separation process to occur. The optical sensor is then exposed to the vehicle component from which the pigment has been depleted. When the pigment is depleted, the optical sensor is able to detect the marker. Example methods and apparatus can also determine whether an ink having a detected marker is being used in an unauthorized manner and, if so, take measures to restrict the usage of the ink. In some examples, the measures taken to restrict to usage of the ink can include halting the operation of the printer in which the ink is being used, generating a display message alerting the user to the presence of the ink, generating a report identifying the unauthorized attempt to use the ink, etc.

These and other example methods, apparatus, systems and articles of manufacture (e.g., physical storage media) to detect and restrict usage of a subscription ink are disclosed in further detail below.

FIG. 1A illustrates an example ink monitor 10 having an example optical sensor 15 and an example controller 20. The example optical sensor 15 senses a vehicle component 25 of a pigment ink and the controller 20 generates a printer control signal based on whether the optical sensor 15 detects a marker in the vehicle component 25.

Figure 1B:
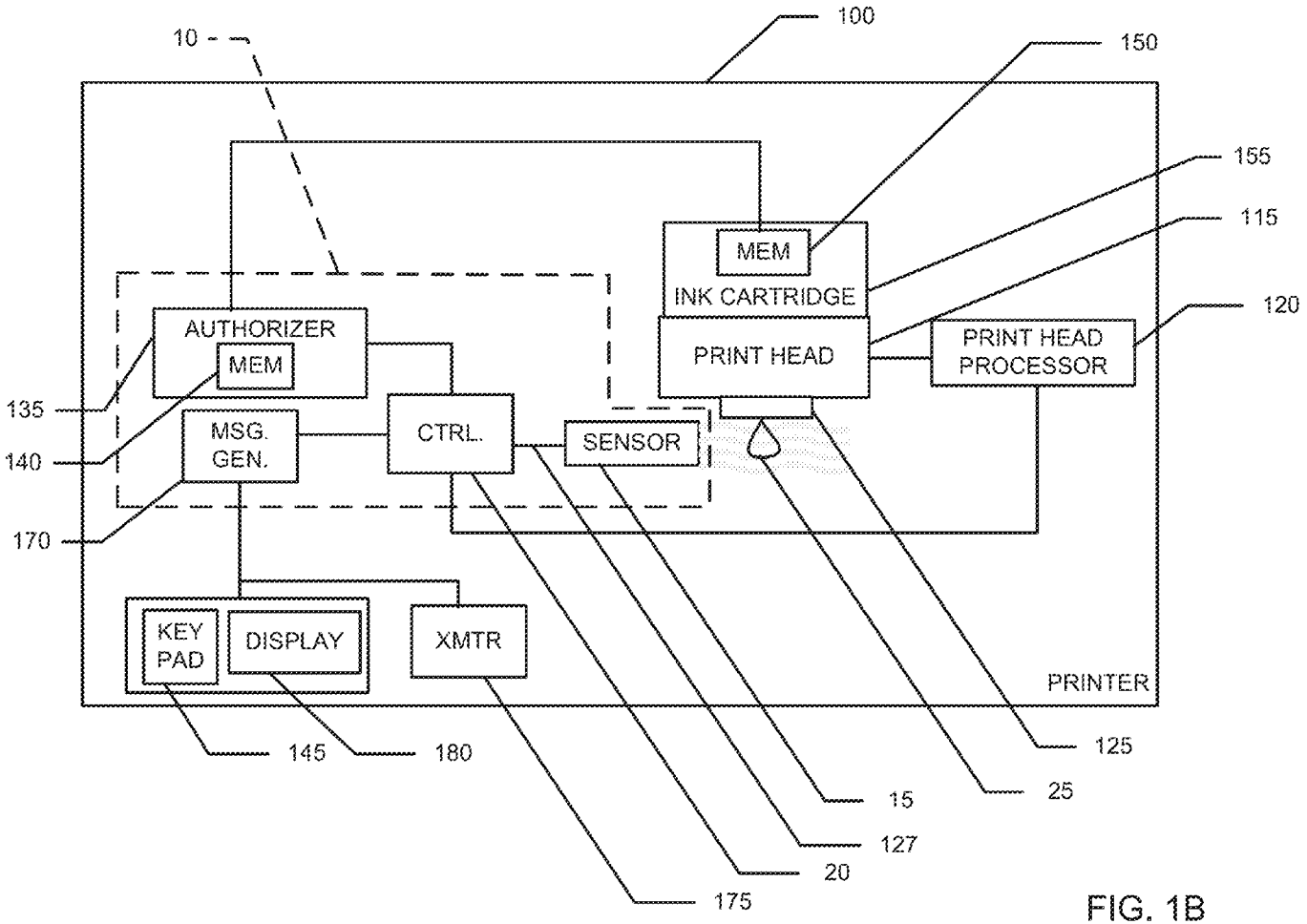
FIG. 1B is a block diagram of an example printer having the example ink monitor of FIG. 1.

FIG. 1B illustrates a printer 100 having the example ink monitor 10 of FIG. 1A. The example optical sensor 15 is positioned to sense the drop(s) of ink vehicle component 25 being ejected from an array of inkjet nozzles 125. An example output 127 of the optical sensor 15 is coupled to example the controller 20 for use in controlling operation of an example print head 115 via an example print head processor 120.

Figure 2A:
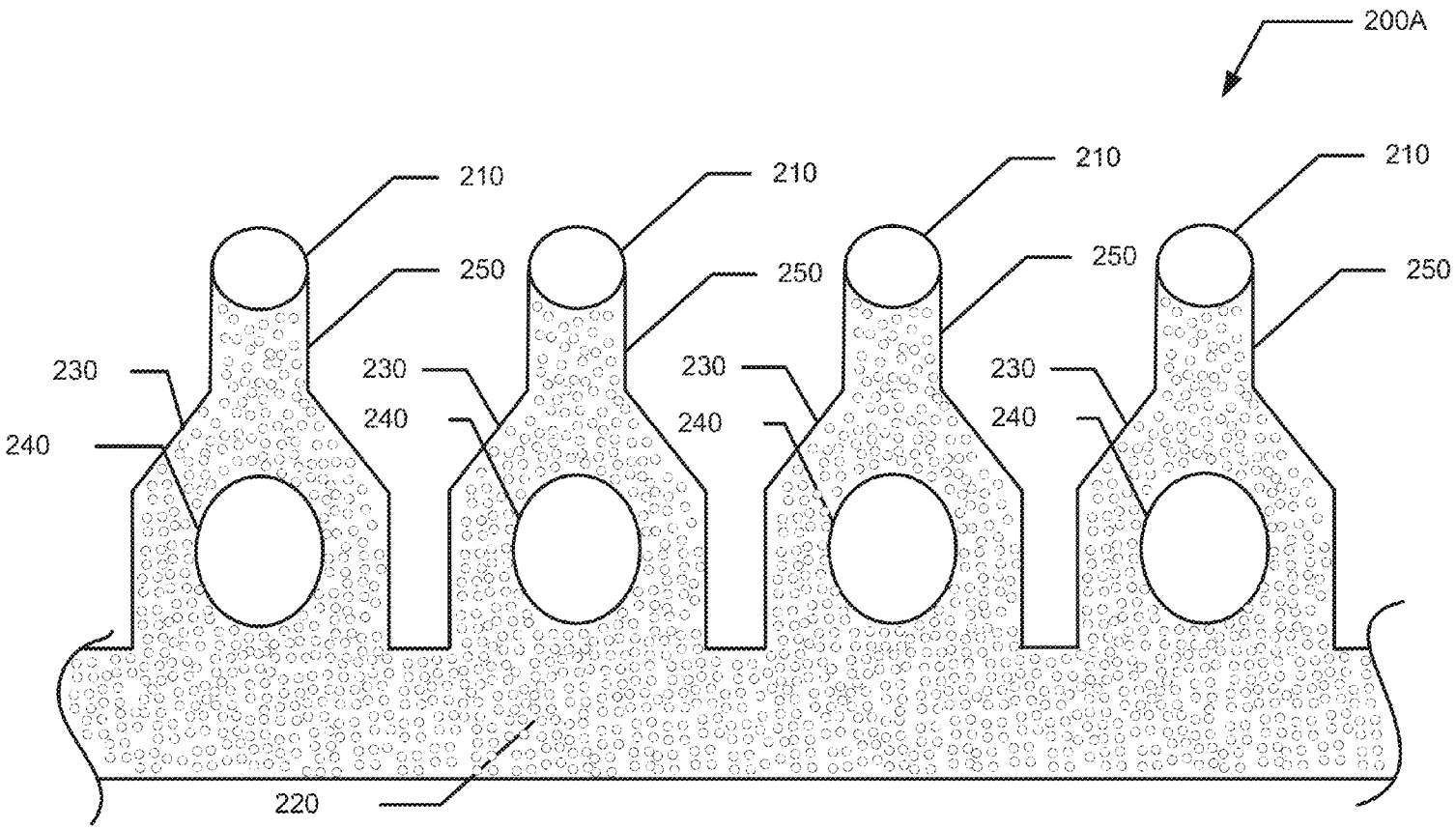
FIG. 2A is a schematic diagram of an ink flow path leading to an inkjet printer nozzle of FIG. 1B in which an ink vehicle component is not depleted of a pigment component.
Figure 2B:
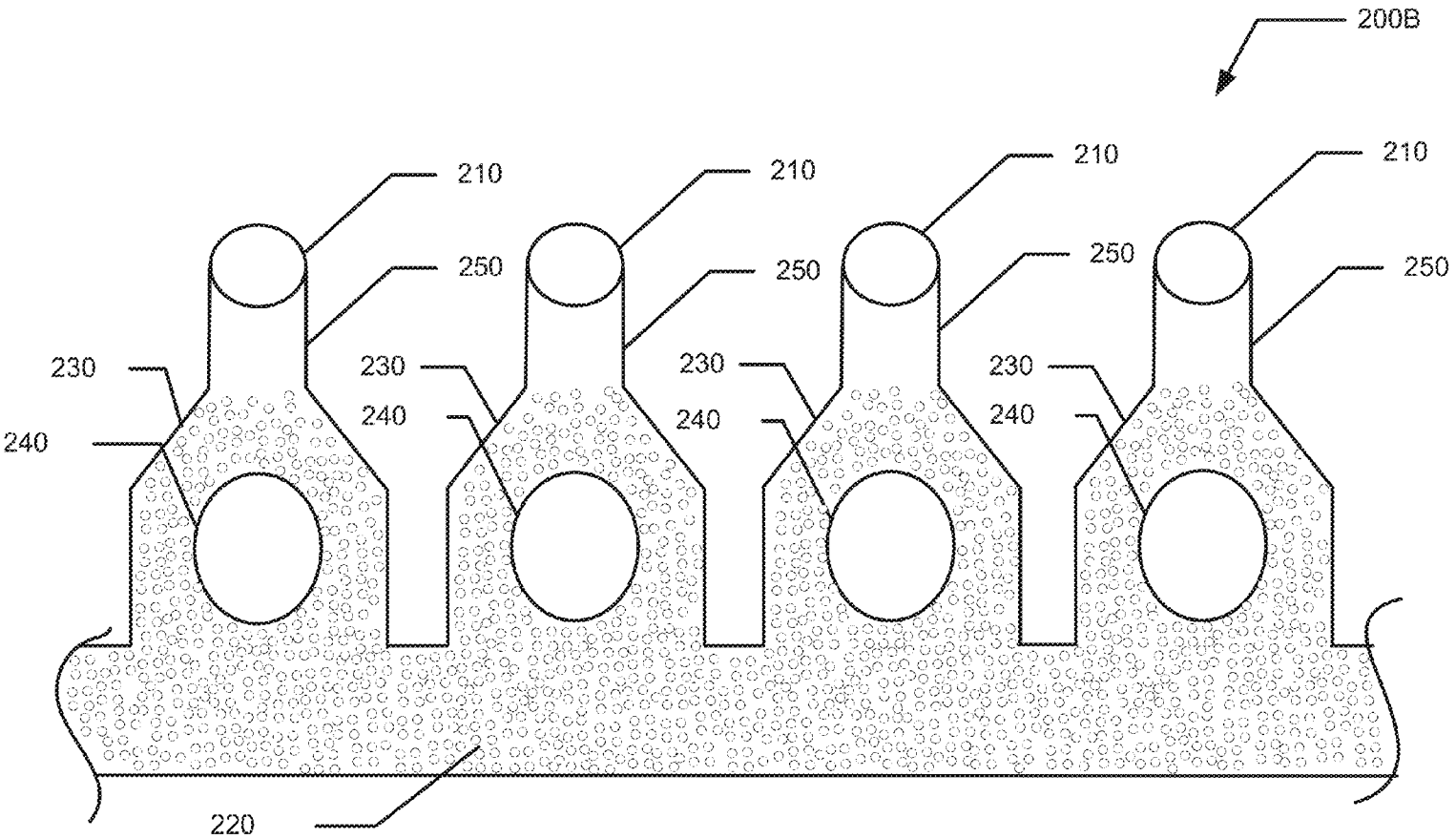
FIG. 2B is a schematic diagram of an ink flow path leading to an inkjet printer nozzle of FIG. 1B in which the vehicle component of the ink is depleted of the pigment component.

FIG. 2A and FIG. 2B are schematic diagrams illustrating a set of example ink flow paths 200, each leading to an orifice 210 of one of the example inkjet nozzles 125 of FIG. 1B. Each of the ink flow paths 200 shares the same ink reservoir 220 through which ink is supplied to each of a set of individual ink reservoirs 230. The ink entering each of the individual ink reservoirs 220 flows around a barrier 240 and into a firing chamber 250 before being ejected from an orifice 210 of the corresponding inkjet nozzle 125. The bubbles shown on FIG. 2A and FIG. 2B represent a pigment component (e.g., pigment particles) of an ink. The pigment particles are disposed/dispersed in an aqueous vehicle component of the ink that is optically clear. As can be seen, the pigment particles (represented by the bubbles) do not extend into the firing chambers 250 shown in FIG. 2B. However, the vehicle component 25 (which has been substantially depleted of the pigment particles) remains.

In some examples, the vehicle component of the ink becomes separated from the pigment component via a phenomenon called pigment retraction (also known as pigment-ink vehicle separation (PIVS)). As a result of pigment retraction, ink residing in the individual ink channels and/or the firing chambers 250 becomes substantially depleted of pigment leaving only the vehicle component 25 of the ink behind.

Returning to FIG. 1B, to clear the example inkjet nozzles 125 of the vehicle component, the inkjet nozzles 125 perform a "spitting" operation by which the vehicle component is ejected from the inkjet nozzles onto, for example, a special absorbing pad or "spittoon." When such a spitting operation is performed, the example optical sensor 15 determines whether an optical marker is present in the vehicle component 25. By performing the sensing operation after the ink has undergone pigment retraction (e.g., by sensing the vehicle component depleted of the pigment component), the example ink monitor is able to detect the optical marker (e.g., even when the optical marker was included in black ink that would have typically prevented detection).

The example optical sensor 15 supplies information about whether the example marker is present (e.g., has been detected) to the example ink monitor 10 which uses the information to control the operation of the printer 100 as described further below.

The example optical marker can be any type of optically detectable substance including an ultraviolet marker, a visible marker, an infrared marker, a near infrared marker, a fluorescing agent, etc. Example fluorescing agents are disclosed in U.S. Patent Publication No. 20115221277 which is incorporated by reference. The optical sensor can be any type of optical sensor capable of detecting the optical marker including, a UV sensor, a visible sensor, an infrared sensor, a near infrared sensor, a camera, etc. One example optical sensor, as disclosed in U.S. Patent Publication No. 20115221277, is a single chip black and white camera. Each such optical sensor includes a corresponding light source to illuminate the optical marker. In some examples, the optical sensor 15 is configured to sense a dye marker that includes a fluorescing agent. In some such examples, the optical sensor 15 includes a filter that removes the wavelength of the light generated by the light source but passes the fluorescing wavelength generated by the dye marker.

In some examples, the optical sensor 15 is a light emitting diode having a wavelength that matches an absorbance peak of the dye marker added to the subscription ink. Such an example optical sensor 15 also includes a phototransistor or photodiode to detect an amount of light absorbed by the vehicle component. Because more light is absorbed when the marker is present, the sensor 15 and/or controller 20 determine that the marker is present when more of the light generated by the LED is absorbed.

In some examples, the example vehicle component, which is typically optically clear, can include water, co-solvents, surfactants, buffering agents, biocides, sequestering agents, viscosity modifiers, humectants, and/or other known additives. In some examples, the vehicle component may also carry polymeric binders, latex particulates, and/or other solids.

Although, for illustrative purposes, the example optical sensor 15 is described as sensing the optical marker after the example vehicle component 25 is spit from the inkjet nozzle 125, the optical sensor can also (or instead) be configured to sense the optical marker contained in the vehicle component when the vehicle component is in any number of other locations (e.g., when the vehicle component is in the example firing chambers 250 of FIGS. 2A and 2B, after the vehicle component has been deposited onto paper or any other print medium, or any other surface in the example printer 100, in a spittoon, etc.). In some examples, the controller 20 (see FIG. 1B, is configured to cause the optical sensor 15 to attempt to sense the marker in the vehicle component 25 after a threshold amount of time has elapsed. The threshold amount of time can be selected to exceed the amount of time it takes for pigment retraction to occur in the firing chambers 250.

Referring again to FIG. 1B, upon being exposed to the example vehicle component 25, the example optical sensor 15 supplies information about whether the example dye marker is detected to the example controller 20. In addition, an example authorizer 135 supplies information to the example controller 20 indicating whether the printer 100 is authorized to use an ink having the marker (e.g., a subscription ink). In some examples, the authorizer 135 determines whether the printer 100 has authorization to use an ink having a marker by accessing a memory device 140 containing authorization information stored therein (e.g., information stored in a tamper-proof storage).

In some examples, the printer 100 is authorized to operate in either a subscription mode or a non-subscription mode. When operating in a subscription mode, the example authorizer 135 informs the example controller 20 that the printer is authorized to use an ink having a marker. When operating in a non-subscription mode, the authorizer 135 informs the example controller 20 that the printer 100 is not authorized to use ink having a marker. In some examples, a user may be supplied an authorization key to be provided to the authorizer 135 via an example keypad 145, or any other input. In some examples, the authorization key is communicated by the printer manufacturer to the printer 100 via the transmitter 175 and installed without user interaction (e.g., stored by the controller 20 for access by the authorizer 135). For example, the printer manufacturer (or any other entity) may operate a web service that transmits the authorization code to the controller 20 upon power up of the printer 100. Upon receiving a valid authorization key, the authorizer 135 informs the controller 20 that the printer 100 is authorized to use ink having the marker. In some examples, the authorizer 135 can access an identification code stored in an example memory 150 associated with an example ink cartridge 155. The identification code can be used by the authorizer 135 to determine whether the ink cartridge 155 is authorized to hold ink having the marker. In some such examples, if the ink cartridge 155 is not authorized to hold ink having the marker, but a marker is detected in the ink, the authorizer 135 can inform the controller 20 that usage of the ink in the cartridge 155 is not authorized.

In some examples, the example printer 100 is configured to operate only in a subscription mode. In some such examples, the ink monitor 10 does not include the example authorizer 135.

In some examples, the example controller 20 receives information from the example optical sensor 15 indicating whether the example optical marker was detected in the vehicle component 25 and receives information from the example authorizer 135 indicating whether the example printer 100 is authorized to use ink having the marker. If, based on the information supplied by the optical sensor 15 and the authorizer 135, the controller 20 determines that the ink includes a marker but that the printer 100 is not authorized to use an ink containing the dye marker, the controller 20 restricts the printer 100 from using the ink. In some examples, the controller 20 restricts the usage of the ink by sending a control signal to an example print head processor 120. The print head processor 120 responds to the control signal by causing an example print head 115 to stop printing. In some examples, the controller 20 also (or instead) causes an example message generator 170 to generator an example message. The message may indicate, for example, that the printer 100 has attempted to perform unauthorized ink consumption. The message may be supplied by the message generator 170 to an example transmitter 175 for delivery to a remote processor and/or a remote display device. In some examples, the remote processor is associated with the manufacturer of the printer and/or ink and the message is used by the manufacturer to track stolen ink. In some examples, the message is delivered to an example local display 180.

Figure 3A:
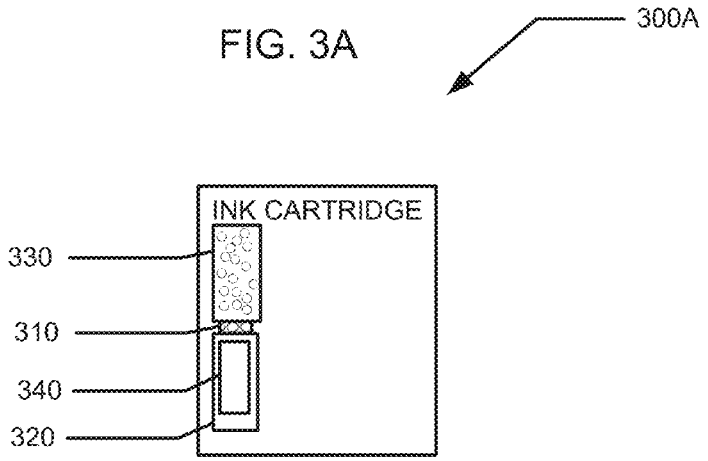
FIG. 3A is a block diagram illustrating the example ink cartridge of FIG. 1B having an example filtration tool.

FIG. 3A is a block diagram 300A illustrating the example ink cartridge 155 of FIG. 1B having an example filtration tool 310 that causes the pigment component to be separated from the example vehicle component. In some such examples, an example detecting chamber 320 is coupled via the filtration tool 310 to an ink reservoir 330. The filtration tool 310 includes an orifice fitted with an example filter membrane. The ink in the ink reservoir 330 is subjected to a positive pressure causing the vehicle component (see FIG. 1A and FIG. 1B) and the dye marker to pass through the filtration tool 310 into the detection chamber 320 which includes an example transparent window 340.

Figure 3B:
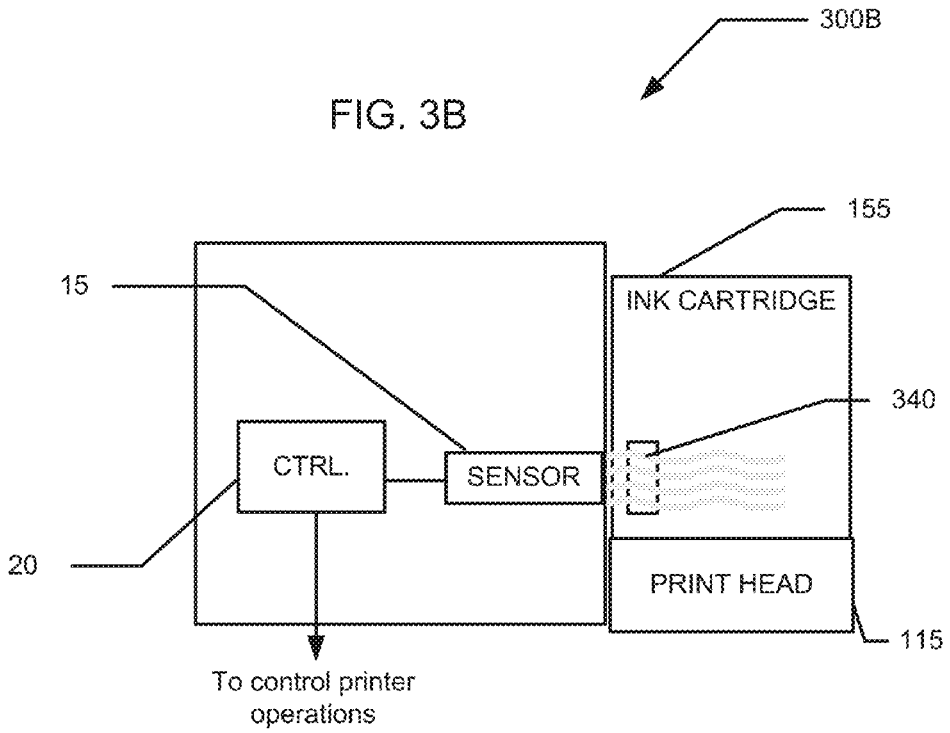
FIG. 3B is a block diagram illustrating the example ink cartridge of FIG. 3A positioned near the example sensor of FIG. 1A and FIG. 1B.

As illustrated in the block diagram 300B of FIG. 3B, the example transparent window 340 is positioned near the example optical sensor 15 thereby allowing the optical sensor 15 to sense the vehicle component through the transparent window 340. The membrane of the filtration tool 310 can be implemented using any type of membrane material that selectively passes the vehicle component 25 and the dye marker but that does not permit passage of the pigment component of the ink. In some examples, the membrane of the filtration tool 310 is implemented using a Pall PTF002LH0A 20 nm filter. In some examples, the vehicle component 25 depleted of the pigment component by the filtration tool 310 is supplied to an inkjet nozzle such as that shown in FIG. 1B. In some such examples, the inkjet nozzle ejects the vehicle component and the sensor is positioned to sense the ejected vehicle component in-flight, or after having landed on a print media or any other surface as described above with reference to FIG. 1B.

While an example manner of implementing the example ink monitor 10 of FIG. 1A is illustrated in FIG. 1B, one or more of the elements, processes and/or devices illustrated in FIG. 1B may be combined, divided, re-arranged, omitted, eliminated and/or implemented in any other way. Further, the example optical sensor 15, the example ink monitor 10, the example controller 20, the example authorizer 135, and the example message generator 170 and/or, more generally, the example ink monitor 10 of FIG. 1A and FIG. 1B may be implemented by hardware, software, firmware and/or any combination of hardware, software and/or firmware. Thus, for example, any of the example optical sensor 15, the example controller 20, the example authorizer 135, and the example message generator 170 and/or more generally, the example ink monitor 10 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example optical sensor 15, the example ink monitor 10, the example controller 20, the example authorizer 135, and the example message generator 170 is/are hereby expressly defined to include a tangible computer readable storage device or storage disk such as a memory, a digital versatile disk (DVD), a compact disk (CD), a Blu-ray disk, etc. storing the software and/or firmware. Further still, the example ink monitor 10 of FIG. 1A and FIG. 1B may include one or more elements, processes and/or devices in addition to, or instead of, those illustrated in FIG. 1A and FIG. 1B, and/or may include more than one of any or all of the illustrated elements, processes and devices.

Figure 4:
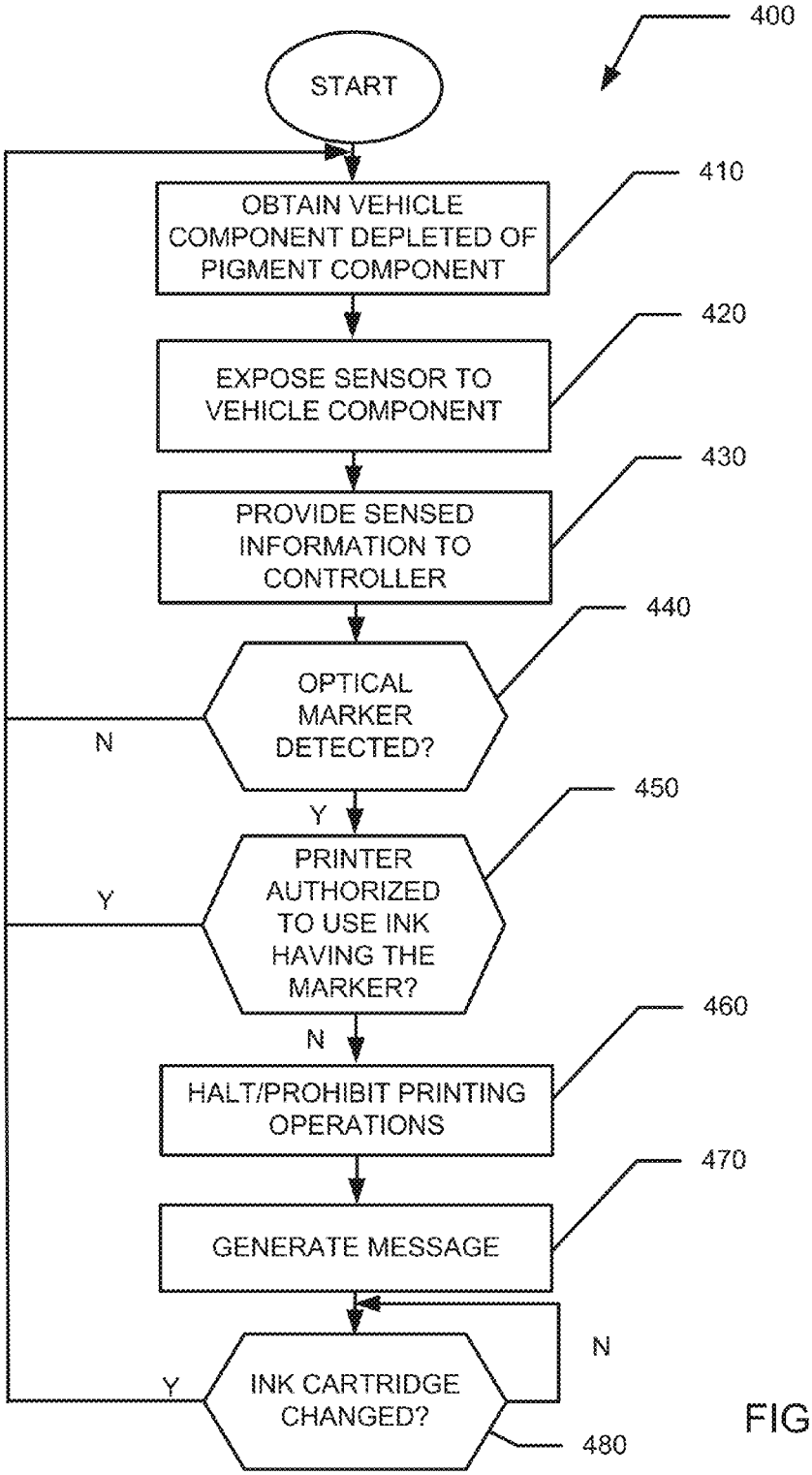
FIG. 4 is a flow chart representative of example machine-accessible instructions that may be executed to implement the ink monitor of FIGS. 1A and 1B.

A flowchart representative of example machine readable instructions for implementing the example ink monitor 10 of FIG. 1A and FIG. 1B is shown in FIG. 4. In this example, the machine readable instructions comprise a program for execution by a processor such as the processor 512 shown in the example processor platform 500 discussed below in connection with FIG. 5. The program may be embodied in software stored on a tangible computer readable storage medium such as a CD-ROM, a floppy disk, a hard drive, a digital versatile disk (DVD), a Blu-ray disk, or a memory associated with the processor 512, but the entire program and/or parts thereof could alternatively be executed by a device other than the processor 512 and/or embodied in firmware or dedicated hardware. Further, although the example program is described with reference to the flowchart illustrated in FIG. 4, many other methods of implementing the example ink monitor 10 of FIG. 1A and FIG. 1B may alternatively be used. For example, the order of execution of the blocks may be changed, and/or some of the blocks described may be changed, eliminated, or combined.

As mentioned above, the example processes of FIG. 4 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIG. 4 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The program 400 of FIG. 4 begins at a block 410 at which the example vehicle component 25 (see FIG. 1A and FIG. 1B) is obtained. Once obtained, the example optical sensor 15 (see FIG. 1A and FIG. 1B) is exposed to the vehicle component 25 (block 420). In some examples, the optical sensor 15 is exposed to the vehicle component 25 when the example inkjet nozzle 125 (see FIG. 1B) ejects the vehicle component 25 of an ink installed in the example printer 100 (see FIG. 1B). The optical sensor 15 senses the vehicle component 25 and provides information to the example controller 20 (see FIG. 1A and FIG. 1B) indicating whether an optical marker has been detected in the vehicle component (block 430). If, based on the supplied information, the controller 20 determines that a marker was not detected (block 440), the program returns to the block 410.

If the example controller 20 determines that the optical sensor-supplied information indicates that a marker was detected, the controller 20 responds by seeking authorization information from the example authorizer 135 (see FIG. 1B) (block 450). The example authorizer 135 responds by determining whether the printer 100 is authorized to use ink having the marker and provides the authorization information to the example controller 20 (block 450). If the authorization information indicates that the example printer 100 (see FIG. 1B) is authorized to use ink having the marker, the program returns to the block 410 and blocks subsequent thereto as described above.

If the authorization information indicates that the example printer 100 is not authorized to use ink having the marker, the example controller 20 sends a control signal to the example print head processor 120 (see FIG. 1B) to cause the print head 115 to halt printing operations (block 460). In some examples, the control signal also prevents printing operations from resuming until the example ink cartridge 155 (see FIG. 1B) is removed from the printer and a new ink cartridge is installed therein.

In some examples, at a block 470, the example controller 20 also causes the example message generator 170 (see FIG. 1B) to generate a message. In some examples, the message indicates that unauthorized ink consumption was attempted. In some examples, the message further includes the model number of the example printer 100 that made the unauthorized attempt and/or a cartridge code associated with the ink cartridge 155 that contains the subscription ink. In some examples, the message further indicates steps that the user of the printer 100 can undertake to restart the printer 100, a phone number to call regarding the subscription ink, etc. In some examples, the message generator 170 transmits the message to a remote processor associated with the printer manufacturer, a remote processor associated with the user and/or the example local printer display 180. In some examples, the message takes the form of a report identifying information about the unauthorized consumption attempt, such as the time of day, the date, cartridge identifying information, printer identifying information user identifying information, ink characteristic information, etc.

The example controller 20 determines whether the example ink cartridge 155 (see FIG. 1B) has been changed (block 480). If the ink cartridge 155 has been changed, the program 400 returns to the block 410 and the blocks subsequent thereto as described above. If the ink cartridge 155 has not yet been changed, the program stalls (block 480)

until the ink cartridge 155 has been changed and then returns to the block 410 at which the example vehicle component 25 is again obtained.

In some examples, the example vehicle component 25 sensor 15 may be obtained (block 410) each time a new example ink cartridge 155 is been installed. In some examples, the vehicle component may be obtained each time a print operation begins or at any other desired time/frequency.

In some examples, the message generated by the example message generator 170 indicating that unauthorized ink consumption was attempted is received by a remote processor associated with the printer manufacturer. The printer manufacturer can respond to the message by sending a control signal back to the example controller 20. In some examples, the controller 170 responds to the control signal by causing the example print head 115 to resume printing operations. In some examples, the printer manufacturer responds to the message by transmitting a code to the user of the example printer 100. The user supplies the code to the controller 170 via the example keypad 145. The controller 170 responds to the code by causing the print head 115 to resume printing operations.

Figure 5:
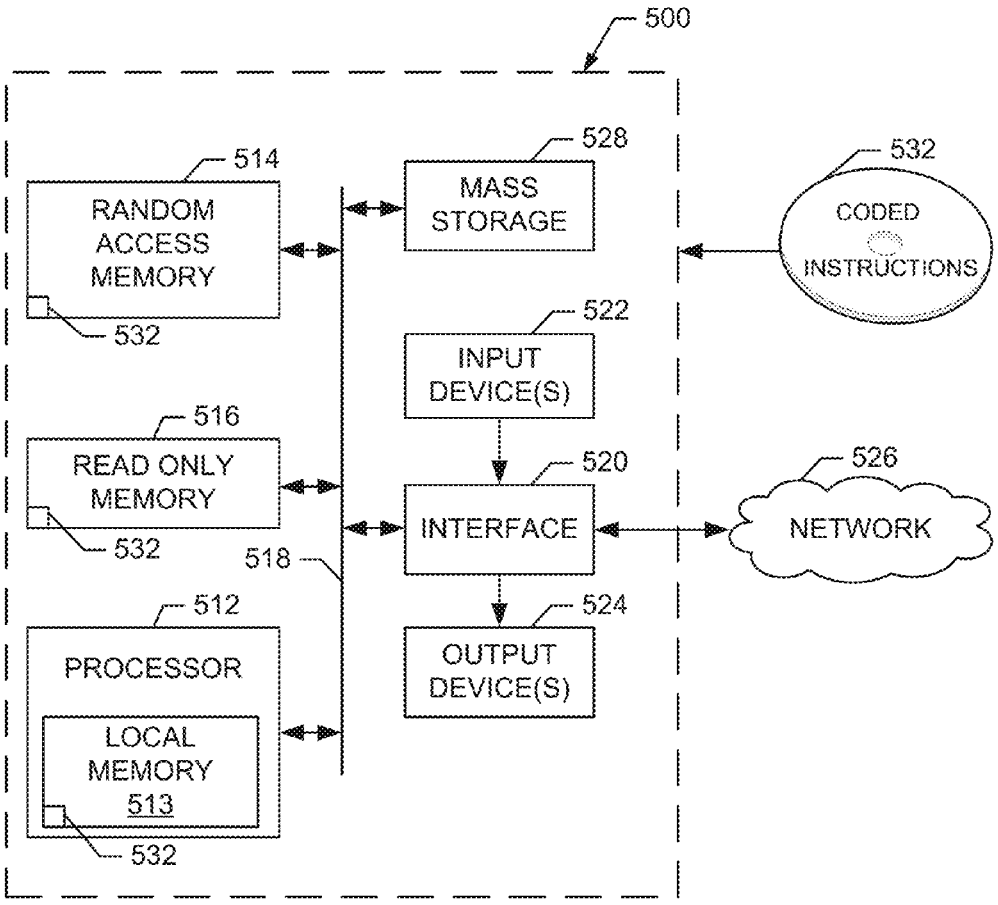
FIG. 5 is a schematic illustration of an example processor platform that may be used and/or programmed to execute the example processes and/or the example machine-accessible instructions of FIG. 4 and/or to implement any, or all, of the example methods, apparatus and/or articles of manufacture described herein.

FIG. 5 is a block diagram of an example processor platform 500 capable of executing the instructions of FIG. 4 to implement the apparatus of FIG. 1A and FIG. 1B. The processor platform 500 can be, for example, a server, a personal computer, an Internet appliance or any other type of computing device.

The processor platform 500 of the illustrated example includes a processor 512. The processor 512 of the illustrated example is hardware. For example, the processor 512 can be implemented by one or more integrated circuits, logic circuits, microprocessors or controllers from any desired family or manufacturer.

The processor 512 of the illustrated example includes a local memory 513 (e.g., a cache). The processor 512 of the illustrated example is in communication with a main memory including a volatile memory 514 and a non-volatile memory 516 via a bus 518. The volatile memory 514 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 416 may be implemented by flash memory and/or any other desired type of memory device. Access to the main memory 514, 516 is controlled by a memory controller.

The processor platform 500 of the illustrated example also includes an interface circuit 520. The interface circuit 520 may be implemented by any type of interface standard, such as an Ethernet interface, a universal serial bus (USB), and/or a PCI express interface.

In the illustrated example, one or more input devices 522 are connected to the interface circuit 420. The input device(s) 522 permit(s) a user to enter data and commands into the processor 512. The input device(s) can be implemented by, for example, an audio sensor, a microphone, a keyboard, a button, a mouse, a touchscreen, a track-pad, a trackball, isopoint and/or a voice recognition system.

One or more output devices 524 are also connected to the interface circuit 520 of the illustrated example. The output devices 524 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 520 of the illustrated example, thus, typically includes a graphics driver card, a graphics driver chip or a graphics driver processor.

The interface circuit 520 of the illustrated example also includes a communication device such as a transmitter, a receiver, a transceiver, a modem and/or network interface card to facilitate exchange of data with external machines (e.g., computing devices of any kind) via a network 526 (e.g., an Ethernet connection, a digital subscriber line (DSL), a telephone line, coaxial cable, a cellular telephone system, etc.).

The processor platform 500 of the illustrated example also includes one or more mass storage devices 528 for storing software and/or data, Examples of such mass storage devices 528 include floppy disk drives, hard drive disks, compact disk drives, Blu-ray disk drives, RAID systems, and digital versatile disk (DVD) drives.

Coded instructions 532, such as the coded instructions described with reference to FIG. 4, may be stored in the mass storage device 528, in the volatile memory 514, in the non-volatile memory 516, and/or on a removable tangible computer readable storage medium such as a CD or DVD.

From the foregoing, it will be appreciated that the above disclosed methods, apparatus and articles of manufacture are able to detect a marker in a black pigment ink or any other ink thereby providing an improved method for detecting unauthorized consumption of subscription ink. It should also be appreciated that, although the methods described herein detect an optical marker added to a subscription ink, an optical marker may instead be added to a non-subscription ink. When the marker is added to the non-subscription ink instead of the subscription ink, the example methods, apparatus and articles of manufacture disclosed herein can be used to detect the absence of the optical marker and prevent the usage of inks that do not have the optical marker from being used with a leased printer or any other type of printer. In some examples, a first optical marker may be added to a subscription ink and a second optical marker may be added to a non-subscription ink. In some such examples, the ink monitor 10 of FIG. 1A and FIG. 1B is configured to determine whether a detected marker (e.g., either the first or the second marker) is associated with a subscription ink or a non-subscription ink and to allow or prohibit printing based on whether the printer 100 is authorized for subscription ink consumption.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

an inkjet nozzle to dispense a pigment ink, the pigment ink including a pigment component and a vehicle component, the inkjet nozzle to perform a spitting operation to eject the vehicle component depleted of the pigment component;

an optical sensor to detect a marker in the vehicle component depleted of a pigment component when a spitting operation is performed; and a controller to control operation of a printer based on whether the optical sensor detects the marker in the vehicle component.

2. An apparatus as defined in claim 1 further comprising an authorizer to determine whether the printer in which the pigment ink is installed is authorized to use the pigment ink having the marker.

3. An apparatus as defined in claim 2 wherein the controller is to control operation of the printer by transmitting a control signal to a print head processor, the control signal to cause the print head processor to halt printing operations.

4. An apparatus as defined in claim 1 further comprising a message generator, the controller to cause the message generator to generate a message indicating that unauthorized ink consumption has been attempted.

5. An apparatus as defined in claim 1 further comprising a filter to deplete the vehicle component of the pigment component.

6. A tangible machine readable storage medium comprising instructions that, when executed, cause a machine to at least:

determine whether a marker is present in a vehicle component of a pigment ink, the pigment ink including the vehicle component and a pigment component, the determining whether a marker is present being performed when a spitting operation is performed, the spitting operation ejecting the vehicle component depleted of the pigment component; and control operation of a printer in which the pigment ink is installed based on whether the marker is present in the vehicle component of the pigment ink.

7. A tangible machine readable storage medium as defined in claim 6, wherein the instructions are further to cause the machine to determine whether the printer is authorized to use the pigment ink having the marker.

8. A tangible machine readable storage medium as defined in claim 7, wherein the instructions cause the machine to control operation of the printer based on whether the marker is present and based on whether the marker is present in the vehicle component and whether the printer is authorized to use the pigment ink having the marker.

9. A tangible machine readable storage medium as defined in claim 8, wherein the instructions cause the machine to control operation of the printer by causing the machine to halt printing operations if the marker is determined to be present and the printer is not determined to be authorized to use the pigment ink having the marker.

10. A tangible machine readable storage medium as defined in claim 6 further comprising an instruction to cause the machine to actuate a filter to remove a pigment component from the vehicle component of the pigment ink.

11. A method comprising:

performing a spitting operation to eject a vehicle component of a pigment ink, the pigment ink including the vehicle component and a pigment component, the spitting operation ejecting the pigment ink depleted of the pigment component;

determining, using an optical sensor, whether a marker is in the vehicle component of the pigment ink when the spitting operation is performed; and detecting an unauthorized attempt to consume the pigment ink based on whether the marker is detected.

12. A method as defined in claim 11, further comprising controlling operation of a printer in which the pigment ink is installed based on whether the unauthorized attempt is detected.

13. A method as defined in claim 11 wherein detecting the unauthorized attempt is further based on whether a printer in which the pigment ink is installed is authorized to use the pigment ink having the marker.

14. A method as defined in claim 13 further comprising controlling operation of the printer in which the pigment ink is installed based on whether the unauthorized attempt is detected.

15. A method as defined in claim 11 further comprising filtering the pigment ink to deplete the pigment component from the vehicle component.

* * * * *